US005122161A

United States Patent [19]

Benfaremo et al.

[11] Patent Number: 5,122,161

[45] Date of Patent: Jun. 16, 1992

[54] DIESEL FUEL COMPRISING A GLYCOLATED MANNICH COUPLED BIS-SUCCINIMIDE DETERGENT

[75] Inventors: Nicholas Benfaremo, Wappingers Falls; Kashmir S. Virk, Hopewell Junction; Sheldon Herbstman, Wappingers Falls, all of N.Y.

[73] Assignee: Texaco Inc., White Plains, N.Y.

[21] Appl. No.: 636,469

[22] Filed: Dec. 31, 1990

[51] Int. Cl.[5] ..... C10L 1/22

[52] U.S. Cl. ..... 44/348

[58] Field of Search ..... 44/347, 348; 545/520

[56] References Cited

U.S. PATENT DOCUMENTS

| | | | |
|---|---|---|---|
| 4,501,595 | 2/1985 | Sung et al. | 44/347 |
| 4,533,361 | 8/1985 | Sung et al. | 44/347 |
| 4,631,070 | 12/1986 | Plavac | 44/347 |
| 4,636,322 | 1/1987 | Nalesnik | 548/520 |
| 5,030,249 | 7/1991 | Herbstmann et al. | 44/348 |
| 5,039,307 | 8/1991 | Herbstmann et al. | 44/348 |

*Primary Examiner*—Prince Willis, Jr.
*Assistant Examiner*—Jerry D. Johnson
*Attorney, Agent, or Firm*—Robert A. Kulason; James J. O'Loughlin; Vincent A. Mallare

[57] ABSTRACT

A diesel fuel composition comprising:

(a) a major portion of a diesel fuel, and (b) a minor amount, as a diesel fuel injector detergent, of a glycolated Mannich coupled product of bis-polyisobutylene succinimide of a polyamine, prepared by:

(i) reacting an alkenylsuccinic acid anhydride with a polyamine to form a bis-succinimide;

(ii) treating the bis-succinimide with a phenol in the presence of an aldehyde to form a Mannich phenol coupled bis-succinimide product;

(iii) glycolating the Mannich phenol coupled bis-succinimide product with glycolic acid to form a glycolated Mannich phenol coupled bis-succinimide product; and (iv) recovering the glycolated Mannich phenol coupled bis-succinimide product.

3 Claims, 1 Drawing Sheet

DIESEL FUEL COMPRISING A GLYCOLATED MANNICH COUPLED BIS-SUCCINIMIDE DETERGENT

BACKGROUND OF THE INVENTION

This invention relates to diesel fuels, and more particularly, to a diesel fuel injector detergent.

In the use of diesel fuels in diesel engines, the fuel's degradation products build up on metal surfaces and clog the injectors of the diesel engines.

When diesel fuel injectors become clogged or develop deposits, the spray of the fuel into the combustion chamber is not uniform and/or atomized properly, resulting in poor combustion, increased exhaust emissions and smoke and degraded fuel economy and power. Eventually, these deposits build up to the point which would require replacement or some special maintenance. In extreme cases, irregular combustion could cause hot spots on the piston which have resulted in total engine failure requiring a complete engine overhaul or replacement.

Since there has been a need for making certain that diesel fuel injectors are clean during operation of the diesel engines, injector detergents have been developed to keep diesel fuel injectors clean.

According to the present invention, it has been found that a glycolated Mannich coupled bis-succinimide is an excellent cleaning agent for diesel fuels since it prevents diesel fuel injectors from clogging. This result was unexpected since it was not thought that the gasoline detergent would be sufficiently thermally stable to withstand the high temperatures found at the fuel injector tips of the diesel engine.

Thus, it is an object of the present invention to provide a means for keeping diesel fuel injectors clean and to provide a cleaning agent for such diesel fuels to aid in the removal of deposits in diesel engines.

DISCLOSURE STATEMENT

U.S. Pat. No. 07/062,019 now abandoned discloses a diesel fuel injector detergent which comprises a solvent, an alcohol, an amino alkylene-substituted asparagine and an N-alkyl-alkylene diamine.

U.S. Pat. No. 07/269,340 discloses a diesel fuel and injector cleaning agent which comprises a solvent, and an N-alkyl-alkylene diamine.

U.S. Pat. No. 4,997,455 discloses a diesel fuel and injector cleaning additive which comprises a solvent such as a ($C_3$–$C_5$) alcohol and an amino alkylene-substituted asparagine.

U.S. Pat. No. 5,030,249 discloses a gasoline composition comprising: (a) a major portion of a gasoline fuel, and (b) a minor amount, as a gasoline detergent additive, of a Mannich coupled product of bis-polyisobutylene succinimide of a polyamine.

U.S. Pat. No. 5,039,307 discloses a diesel fuel composition comprising: (a) major portion of a diesel fuel, and (b) a minor amount, as a diesel fuel injector detergent additive, of a Mannich coupled product of bis-polyisobutylene succinimide of a polyamine.

SUMMARY OF THE INVENTION

This invention provides a diesel fuel composition which comprises:

(a) a major portion of a diesel fuel, and (b) a minor amount, as a diesel fuel injector detergent, of a Mannich coupled product of bis-poly-isobutylene succinimide of a polyamine, prepared by:

(i) reacting an alkenylsuccinic acid anhydride with a polyamine to form a bis-succinimide;

(ii) treating the bis-succinimide with a phenol in the presence of an aldehyde to form a Mannich phenol coupled bis-succinimide product;

(iii) glycolating the Mannich phenol coupled bis-succinimide product with glycolic acid to form a glycolated Mannich phenol coupled bis-succinimide product;

(iv) recovering the product Mannich phenol coupled bis-succinimide

DRAWING

The advantages of the present invention will be more clear from the description set forth below, particularly when considered with the drawing:

FIG. 1 is a graph illustrating the results of a single cylinder engine which compares a base diesel fuel containing 0.5% residual oil with the same base diesel fuel containing the cleaning agent of the present invention.

DETAILED DESCRIPTION OF THE INVENTION

Figure 1:
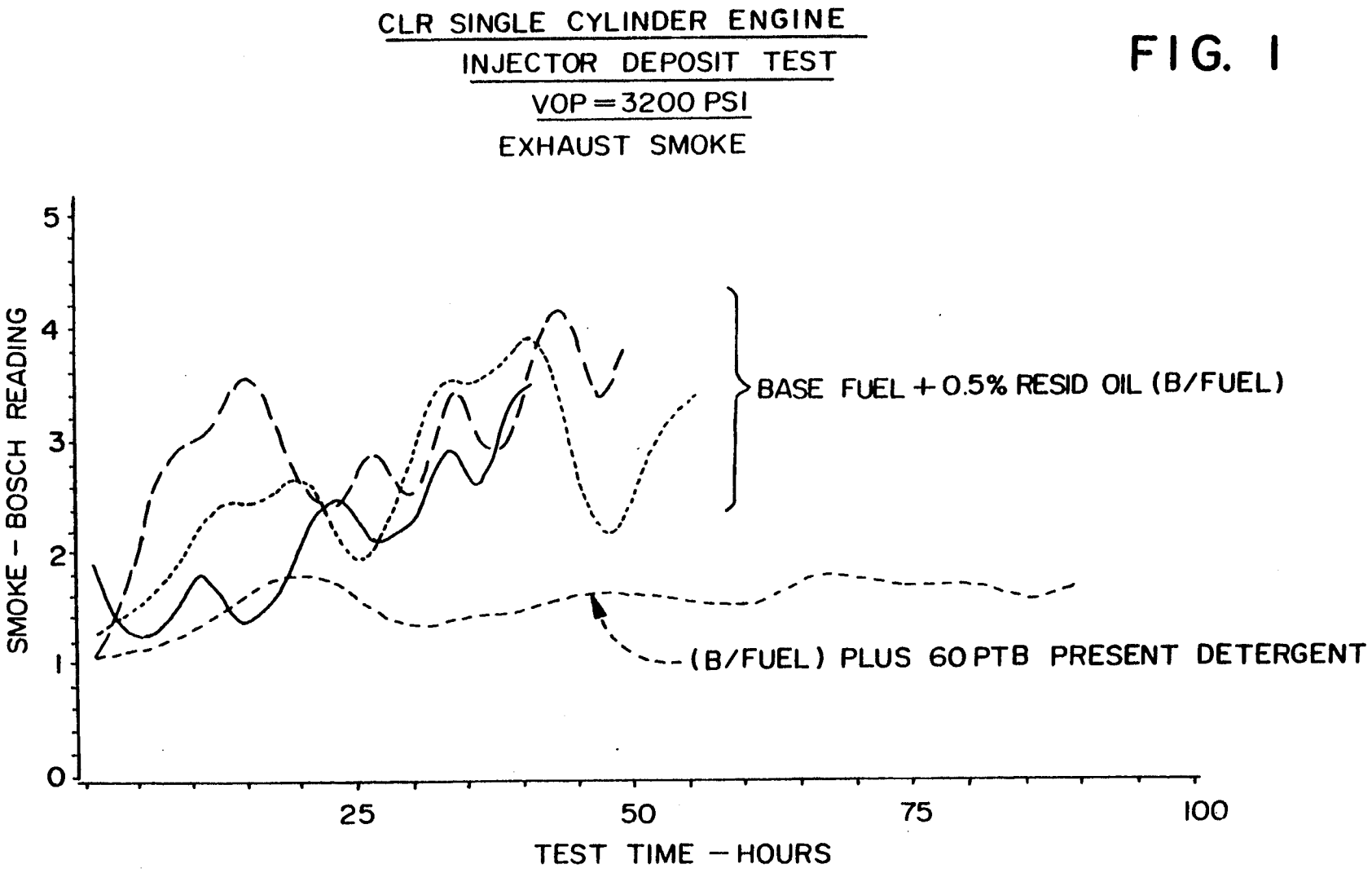

Generally, diesel engines usually run harder and not as well in cold weather as the fuel flow is impeded. The diesel fuel injectors become clogged due to the fuel depositing oxidized materials in injector holes and thus impeding flow.

The present invention utilizes a "keep clean" detergent in a diesel fuel composition to make certain that the fuel injectors are kept clean and functioning properly.

The diesel fuel composition comprises:

(a) a major portion of a diesel fuel, and (b) a minor amount, as a diesel fuel injector detergent, of a glycolated Mannich coupled product of bis-poly-isobutylene succinimide of a polyamine, prepared by:

(i) reacting an alkenylsuccinic acid anhydride with a polyamine to form a bis-succinimide;

(ii) treating the bis-succinimide with a phenol in the presence of an aldehyde to form a Mannich phenol coupled bis-succinimide product;

(iii) glycolating the Mannich phenol coupled bis-succinimide product with glycolic acid to form a glycolated Mannich phenol coupled bis-succinimide product; and (iv) recovering the glycolated Mannich phenol coupled bis-succinimide product.

In preparing the effective additive for removing deposits from diesel fuel injectors, an alkenylsuccinic acid anhydride (ASAA) is used which contains polyisobutylene (PIB) groups and has a molecular weight ranging from about 500 to about 5000. The preferred molecular weight being about 1500, and the most preferred being about 2200. The alkenylsuccinic acid anhydride (ASAA) is identified as H-50 ASAA, H-300 ASAA, H-1500 ASAA, and the like.

The alkenyl succinimide acid anhydride is reacted with a polyamine selected from the group consisting of pentaethylene hexamine (PEHA), diethylenetriamine (DETA), triethylenetetramine (TETA) and tetraethylenepentamine (TEPA).

According to the present invention the phenols that may be used include nonylphenol, The preferred phenol being nonylphenol.

Although other aldehydes may be used in the present method, the preferred aldehyde is paraformaldehyde.

The present detergent when analyzed, has the analytical data shown below in Table 1.

TABLE 1

ANALYTICAL DATA

| TEST | RESULTS |
|---|---|
| Specific Gravity 60/60 F. | 0.905 |
| Kin. Viscosity 40° C. (cSt.) | 4000 |
| Kin. Viscosity 100° C. (cSt) | 162 |
| Flash, COC, F. | 430 |
| % Nitrogen | 0.70 |
| TAN | 4.0 |
| TBN | 9.0 |

The amine and ASAA (alkenylsuccinic acid anhydride) which has a polyisobutylene (PIB) radical attached, are reacted at a temperature of about 80° C. to about 120° C. for about 1 to 2 hours to produce a bis-succinimide. The bis-succinimide is then reacted with a phenol such as nonylphenol

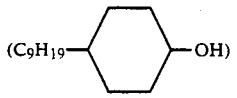

and an aldehyde such as paraformaldehyde $(CH_2O)_x$ to form the product, i.e., a Mannich phenol coupled bis-succinimide.

The bis-succinimide is then further treated, i.e., glycolated, with glycolic acid and at a temperature of about 160° C. and then cooled to produce the ultimate product (i.e., the present cleaning agent), a glycolated Mannich phenol coupled bis-succinimide. This product is represented by the following formula:

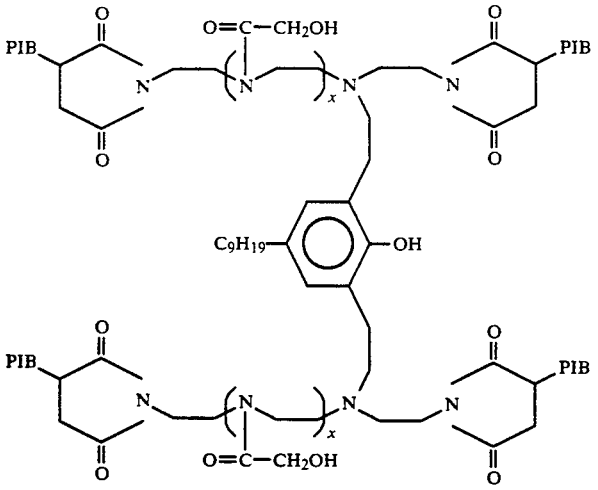

x = 1–4

When using a specific amine, phenol and aldehyde, the process for preparing the present detergent "succinimide" useful in removing deposits from clogged injectors of diesel engine. The process includes essentially three steps which are:

(1) reacting an alkenylsuccinic acid anhydride (ASAA) with a polyamine such as pentaethylenehexamine (PEHA) to provide a bis-succinimide;

(2) then reacting the bis-succinimide with nonylphenol and paraformaldehyde to form the intermediate product, i.e., a Mannich phenol coupled bis-succinimide; and (3) glycolating the intermediate Mannich phenol coupled bis-succinimide with glycolic acid to produce a glycolated Mannich phenol coupled bis-succinimide.

The advantages of the present invention will be more apparent when considering the following examples:

EXAMPLE I

Preparation Of Glycolated Mannich Reaction Product Detergent

Into a 4 neck 12 liter round bottom flask equipped with a mechanical stirrer, was added the 100 E Pale Stock HF (3200 g) and the alkenylsuccinic acid anhydride (4000 g, 1.15 moles). The mixture was stirred under nitrogen and then pentaethylenehexamine (167 g, 0.63 moles) was added and the reaction mixture heated to 120° C. and maintained for 2 hrs. Nonylphenol (70.9 g, 0.315 moles) was then added followed by a formalin solution (37%) (102 g, 1.26 moles) which was added over ten minutes. Thirty minutes after the addition of the formaldehyde was completed, glycolic acid (70%) (182 g, 1.7 moles) was added and the reaction mixture was then heated to 160° C. and maintained for four (4) hrs. The crude product was then cooled to 100° C. and filtered through Celite (200 g) to provide the present cleaning agent, i.e., a glycolated Mannich phenol coupled bis-succinimide.

EXAMPLE II

Comparison Test Detergent

Referring to FIG. 1, the effectiveness of the present cleaning agent is illustrated therein by showing the results of tests.

In preparing the diesel engine for the tests the dirty injector nozzle, needle and other injector parts were cleaned in an Ultra Sonic Cleaner using "Citrikleen HD" cleaning solution. After all carbonaceous material was removed from injector parts (nozzle, nozzle holes, needle, etc.), the injector was reassembled and the valve opening pressure was set at 3200 psi. After inspecting the spray pattern and checking the back leakage, the injector was installed in an engine for testing of the next base fuels, e.g., the base fuel with the present cleaning agent.

The typical test conditions under which the direct injection engine was operated for evaluation of agents to keep injector clean were as follows:

| | |
|---|---|
| Engine Speed RPM | 1600 |
| Fuel Rate, lbs/hr | 3.0 |
| Air Rate, SCFM | 21.0 (1.587 lbs/min) |
| Air Fuel Ratio | 31.7 |
| Injection Timing, BTDC | 8.5 |
| Intake Air Temp, °F. | 150 |
| Jacket Temp, °F. | 176 |

Under these conditions, an additive fuel was tested for its effectiveness to keep injector parts clean. During a test, the engine power, exhaust smoke and other engine operating conditions were monitored. Changes in exhaust smoke and engine power were considered to be measures for effectiveness of a test agent to keep the injector clean.

As illustrated in FIG. 1., the addition of the present cleaning agent to a base diesel fuel containing 0.5% residual oil is effective in keeping the smoke level in the burning of a diesel fuel at minimal levels. The present cleaning agent was evaluated at 60 PTB in diesel fuel as a fuel injector 'keep clean' agent. The results, which are shown in Fig. 1., indicate that the present cleaning agent is extremely active. For example, a base diesel fuel containing 0.5% residual oil caused fairly high smoke levels of 3–4 Bosch numbers with 50 hours of run time, whereas the present cleaner at 60 PTB in the same base diesel fuel (containing 0.5% residual oil) gave much lower smoke levels over the 50 hr run time.

We claim:

1. A diesel fuel composition comprising:

(a) a major portion of a diesel fuel, and (b) a minor amount, as a diesel fuel injector detergent, of a glycolated Mannich coupled product of bis-polyisobutylene succinimide of a polyamine, prepared by:

(i) reacting an alkenylsuccinic acid anhydride having a molecular weight of about 500 to about 5,000 with a polyamine selected from the group consisting of pentaethylene hexamine, diethylenetriamine, triethylenetetramine, and tetraethylene pentamine form a bis-succinimide;

(ii) treating said bis-succinimide with a nonylphenol in the presence of an aldehyde to form a Mannich phenol coupled bis-succinimide product;

(iii) glycolating the Mannich phenol coupled bis-succinimide product with glycolic acid to form a glycolated Mannich phenol coupled bissuccinimide product; and (iv) recovering said glycolated Mannich phenol coupled bis-succinimide product.

2. The diesel fuel composition of Claim 1, wherein said amine is pentaethylenehexamine.

3. The diesel fuel composition of 1, wherein the molecular weight of the polyisobutenyl group of said alkenylsuccinic acid anhydride is about 2200.

* * * * *